US008149561B2

(12) United States Patent
Shimanaka

(10) Patent No.: US 8,149,561 B2
(45) Date of Patent: Apr. 3, 2012

(54) ION GENERATOR

(75) Inventor: Yasuhiko Shimanaka, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 206 days.

(21) Appl. No.: 12/505,651

(22) Filed: Jul. 20, 2009

(65) Prior Publication Data

US 2009/0272912 A1 Nov. 5, 2009

Related U.S. Application Data

(63) Continuation of application No. PCT/JP2008/069300, filed on Oct. 24, 2008.

(30) Foreign Application Priority Data

Nov. 30, 2007 (JP) ..... 2007-311190

(51) Int. Cl.
*H01T 23/00* (2006.01)
*H01J 27/02* (2006.01)

(52) U.S. Cl. ..... 361/230; 361/213

(58) Field of Classification Search ..... 250/423 R, 250/424, 426, 423 F; 315/111.81–111.91; 361/213, 230, 231
See application file for complete search history.

(56) References Cited

U.S. PATENT DOCUMENTS

| | | | | |
|---|---|---|---|---|
| 2,347,795 | A * | 5/1944 | Podolsky | 338/333 |
| 5,789,749 | A | 8/1998 | Breton | |
| 2006/0159599 | A1 * | 7/2006 | Kiuchi et al. | 422/186.07 |
| 2009/0047189 | A1 * | 2/2009 | Taishi et al. | 422/186.04 |

FOREIGN PATENT DOCUMENTS

| | | | | |
|---|---|---|---|---|
| JP | 63-126044 | U | | 8/1988 |
| JP | 04-206378 | A | | 7/1992 |
| JP | 08-255668 | A | | 10/1996 |
| JP | 11-191478 | A | | 7/1999 |
| JP | 11191478 | A | * | 7/1999 |
| JP | 2003-178854 | A | | 6/2003 |
| JP | 2003-320274 | A | | 11/2003 |
| JP | 2003320274 | A | * | 11/2003 |
| JP | 2005-142131 | A | | 6/2005 |
| JP | 2007-220460 | A | | 8/2007 |
| WO | 2004/019462 | A1 | | 3/2004 |

OTHER PUBLICATIONS

Official Communication issued in International Patent Application No. PCT/JP2008/069300, mailed on Jan. 6, 2009.

Official Communication issued in corresponding Japanese Patent Application No. 2009-526978, mailed on May 31, 2011.

* cited by examiner

*Primary Examiner* — Jack Berman

*Assistant Examiner* — David E Smith

(74) *Attorney, Agent, or Firm* — Keating & Bennett, LLP

(57) ABSTRACT

An ion generator is capable of efficiently generating ions and includes a case accommodating an ion-generating element that generates ions by discharging electricity from a discharging needle electrode and a cover having openings for ion discharge. Resistive elements are disposed at peripheral portions of the openings, and the resistive elements are grounded. Since the resistive elements are grounded, the peripheral portions of the openings are prevented from being electrostatically charged. As a result, retention of ions at the openings is suppressed, and ions are efficiently generated and discharged.

8 Claims, 8 Drawing Sheets

ION GENERATOR

BACKGROUND OF THE INVENTION

1. Field of the Invention

The present invention relates to ion generators, in particular, ion generators that generate ions by electrical discharge between discharging needle electrodes and ground electrodes.

2. Description of the Related Art

Japanese Unexamined Patent Application Publication No. 2005-142131 discloses a static eliminator including a plurality of discharging needle electrodes disposed with a predetermined spacing therebetween in a longitudinal direction and a cover having openings toward which the discharging needle electrodes protrude. The surface resistivity of this cover is set to less than or equal to $10^7$ Ω/mm$^2$.

The cover prevents operators' fingertips from coming into contact with the discharging needle electrodes. However, when the surface resistivity of the cover is less than or equal to $10^7$ Ω/mm$^2$, generated ions are excessively absorbed by the entire cover, resulting in a reduction in static-elimination capacity.

SUMMARY OF THE INVENTION

Accordingly, preferred embodiments of the present invention provide an ion generator capable of efficiently generating and discharging ions.

An ion generator according to a preferred embodiment of the present invention includes an ion-generating element provided in a case, the ion-generating element includes a discharging needle electrode and a ground electrode facing the discharging needle electrode, a cover included in the case and having an opening that faces the discharging needle electrode and a grounded resistive element disposed at a peripheral portion of the opening.

The opening (in particular, the peripheral portion thereof) formed in the cover to discharge ions to the outside is easily electrostatically charged. Thus, ions remain at the opening, and new ions are prevented from being generated. According to the above-described ion generator, the grounded resistive element is disposed at the peripheral portion of the opening in the cover. Therefore, the peripheral portion is prevented from being electrostatically charged, and ions do not remain at the peripheral portion due to moderate ion absorption by the resistive element, resulting in efficient ion generation.

According to a preferred embodiment of the present invention, the grounded resistive element is disposed at the peripheral portion of the opening in the cover. With this unique structure, the peripheral portion is prevented from being electrostatically charged, and ions do not remain at the peripheral portion due to moderate ion absorption by the resistive element, resulting in efficient ion generation and ion discharge.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
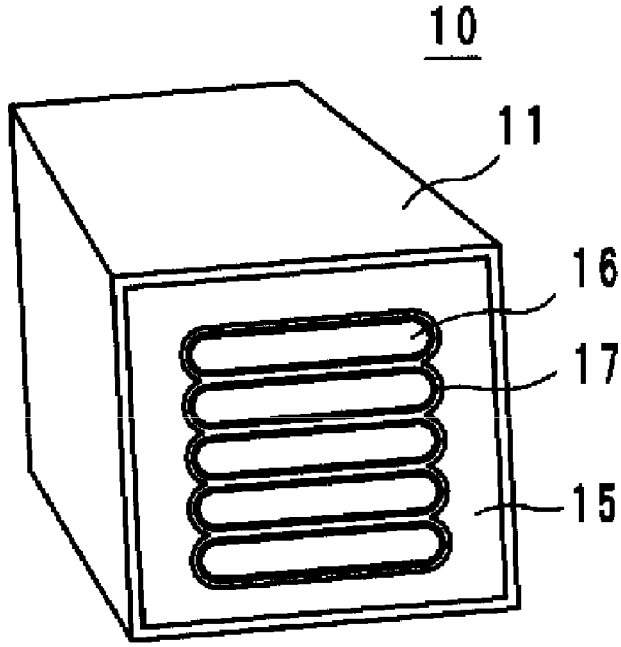
FIG. 1 is a perspective view illustrating an ion generator according to a first preferred embodiment of the present invention.

Ion generators according to preferred embodiments of the present invention will now be described with reference to the drawings. The same reference numbers and symbols are used for components or portions common in the drawings, and the duplicated descriptions will be omitted.

First Preferred Embodiment

See FIGS. 1 to 5

Figure 2:
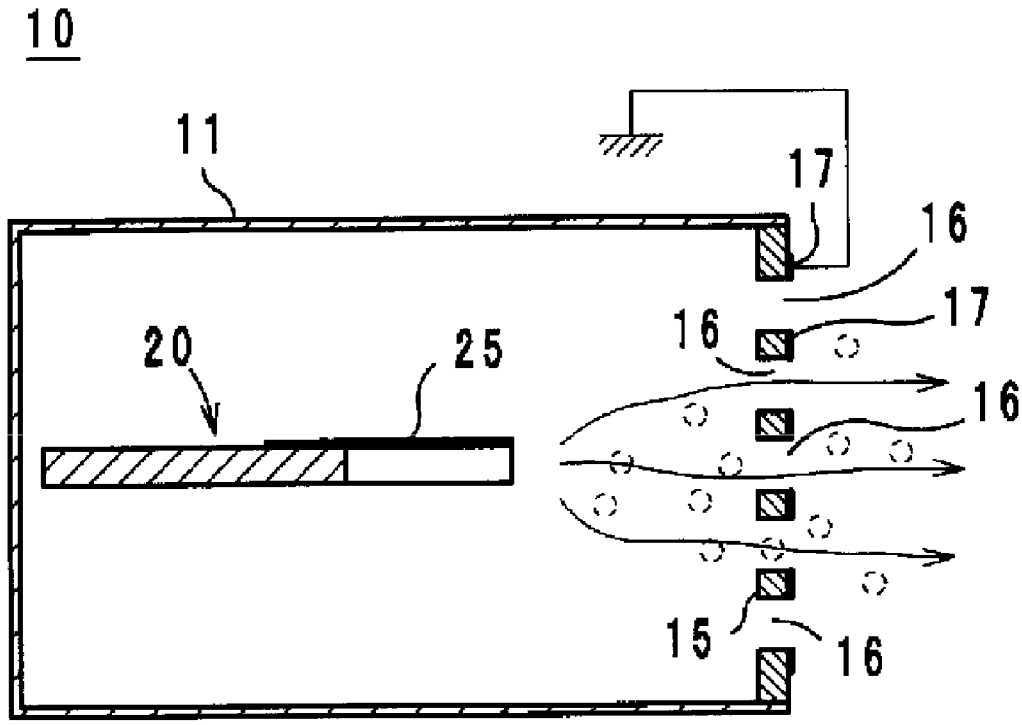
FIG. 2 is a cross-sectional view of the first preferred embodiment of the present invention.
Figure 3A:
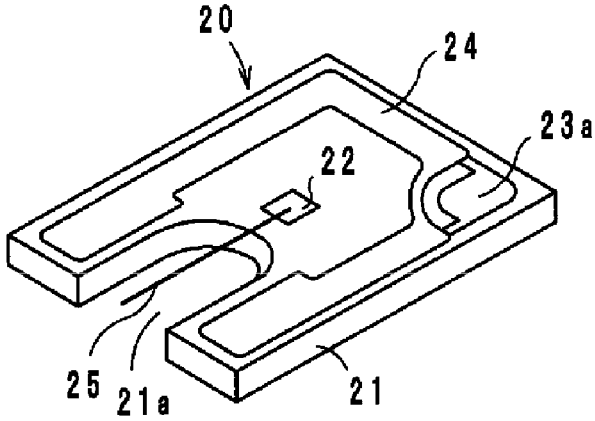
FIGS. 3A and 3B are a perspective view and a plan view, respectively, of an ion-generating element.
Figure 3B:
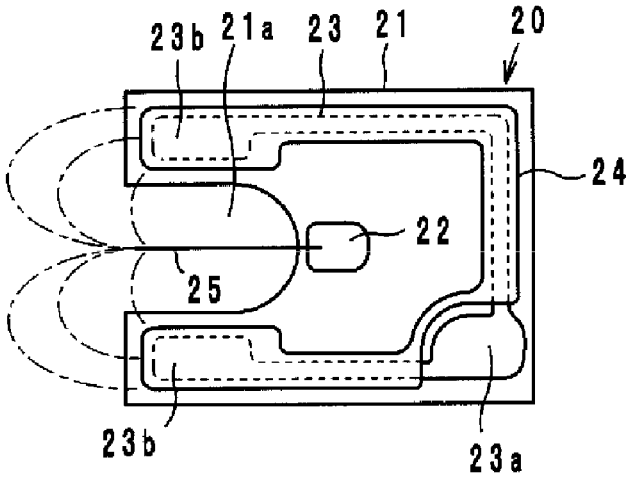

As shown in FIGS. 1 and 2, an ion generator 10 according to a first preferred embodiment of the present invention accommodates an ion-generating element 20 in a case 11, and the case 11 has a cover 15 at the front thereof. As shown in FIGS. 3A and 3B, the ion-generating element 20 includes an insulating substrate 21, a high-voltage electrode 22 and a ground electrode 23 provided on the insulating substrate 21, and an insulating film 24 arranged to cover the ground electrode 23 except for an electrode portion 23*a*. The insulating substrate 21 has a cut-off portion 21*a*, and a linear discharging needle electrode 25 is electrically connected (e.g., soldered) to the high-voltage electrode 22 so as to be disposed at the cut-off portion 21*a*.

The discharging needle electrode 25 preferably is an ultra-thin wire such as a piano wire, a tungsten wire, a stainless steel wire, or a titanium wire; and is disposed between arm ends 23*b* of the ground electrode 23. A high voltage is applied from the high-voltage electrode 22 to the discharging needle electrode 25, and the ground electrode 23 is grounded at the electrode portion 23*a*.

Negative ions or positive ions can be generated by the ion-generating element 20 described above by applying a high negative or positive voltage to the discharging needle electrode 25. That is, when a negative or positive voltage is applied to the discharging needle electrode 25, a strong electric field is generated between the discharging needle electrode 25 and the arm ends 23*b* of the ground electrode 23. This leads to a dielectric breakdown and a corona discharge in the vicinity of the tip of the discharging needle electrode 25, and as a result, negative or positive ions are generated. In this preferred embodiment, a negative voltage is applied so that negative ions are generated.

As shown in FIG. 2, the ion-generating element 20 is disposed in the case 11 such that the tip of the discharging needle electrode 25 faces the cover 15. Generated ions are discharged from openings 16 formed in the cover 15 to the outside as shown by arrows in FIG. 2.

Figure 4:
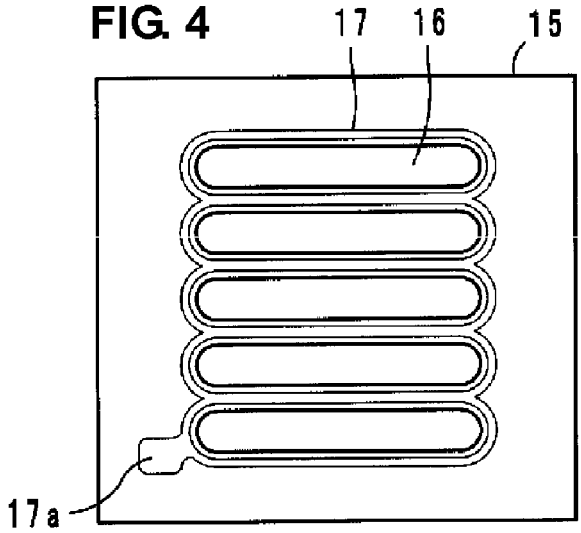
FIG. 4 is a front view illustrating a first shape of openings formed in a cover.

In the first preferred embodiment, resistive elements 17 are disposed at peripheral portions of the openings 16 in the cover 15, and are grounded as shown in FIG. 2. With reference to FIG. 4, the openings 16 formed in the cover 15 preferably are long holes whose ends are arc-shaped. The resistive elements 17 are electrically connected to each other at the peripheral portions (edge portions) of the long holes such that the potentials of the resistive elements 17 become the same, and are grounded at an electrode portion 17*a*. This cover 15 having the long holes serving as the openings 16 as shown in FIG. 4 is referred to as a cover A. In experiments using the cover A described below, specifically, the length and the width of the cover A were both about 20 mm, the width of the openings 16 was about 2 mm and the gaps therebetween were about 1 mm, and the width of the resistive elements 17 was about 0.3 mm, for example.

Figure 5:
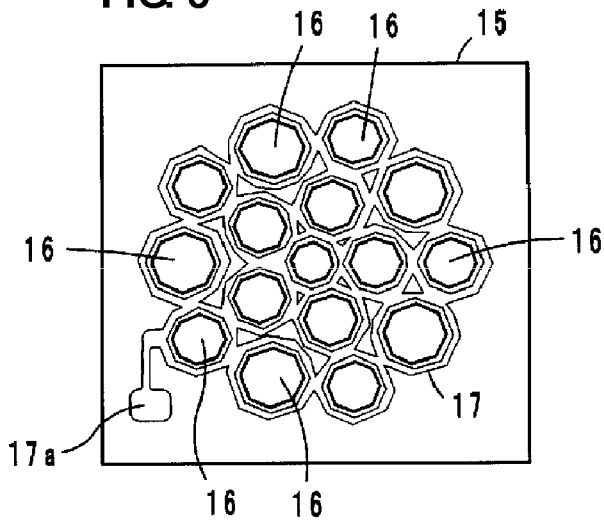
FIG. 5 is a front view illustrating a second shape of the openings formed in the cover.

Moreover, as shown in FIG. 5, the openings 16 can be comprised of a plurality of polygon holes. The resistive elements 17 are electrically connected to each other at the peripheral portions (edge portions) of the polygon holes such that the potentials of the resistive elements 17 become the same, and are grounded at the electrode portion 17*a*. This cover 15 having the openings 16 as shown in FIG. 5 is referred to as a cover B. In experiments using the cover B described below, specifically, the length and the width of the cover 15 were both about 20 mm, the diameter of the large-sized openings 16 was about 3 mm, the diameter of the small-sized openings 16 was about 2 mm, the diameter of the medium-sized openings 16 was about 2.5 mm, and the width of the resistive elements was about 0.3 mm, for example.

Various insulating materials can be used for the cover 15, and an alumina substrate, for example, is used herein. Moreover, the resistive elements 17 are, for example, screen-printed cermet resistors whose sheet resistivity is about 10 $M\Omega/mm^2$. Alternatively, the resistive elements 17 can be carbon resistors. The appropriate sheet resistivity of the resistive elements 17 ranges from about 1 $M\Omega/mm^2$ to about 15 $M\Omega/mm^2$, for example.

In the first preferred embodiment, the grounded resistive elements 17 are disposed at the peripheral portions of the openings 16 in the cover 15. With this, the peripheral portions are prevented from being electrostatically charged, and ions do not remain due to moderate absorption of ions by the resistive elements 17. As a result, ions are efficiently generated. In other words, the resistive elements 17 provided at the peripheral portions of the openings 16, which are easily electrostatically charged and easily retain ions, prevent the peripheral portions from being electrostatically charged, and prevent ions from remaining at the peripheral portions by absorbing the remaining ions. This promotes ion generation and increases the amount of ion discharge. Moreover, ions are not excessively absorbed since the resistive elements are not formed at portions where ions do not easily remain (portions other than the peripheral portions).

Ions can be efficiently discharged through the plurality of openings 16 formed in the cover 15. It is preferable that the aperture ratio of the cover 15 be high and that the size of the openings 16 be increased. However, the openings 16 need to be within predetermined dimension ranges in order to prevent operators from receiving electric shocks when their fingertips come into contact with or come near the discharging needle electrode 25. Therefore, it is preferable that the plurality of openings 16 be formed in the cover 15. Moreover, the alumina substrate serving as the material of the cover 15 is not easily charged with ions, and the resistive elements 17 can be easily formed on the alumina substrate. Furthermore, cermet resistors or carbon resistors have stable resistances, and do not deteriorate markedly.

The purpose of the cover 15 is to prevent operators from receiving electrical shocks when their fingertips come into contact or come near the discharging needle electrode 25. The discharging needle electrode 25 and the cover 15 can be insulated from each other by setting the distance between the tip of the discharging needle electrode 25 and the cover 15 to a potential difference of less than or equal to about 1 kV/mm, for example. With this, operators do not receive electrical shocks even when their fingertips come near or come into contact with the cover 15.

Second Preferred Embodiment

See FIGS. 6 to 10

Figure 6:
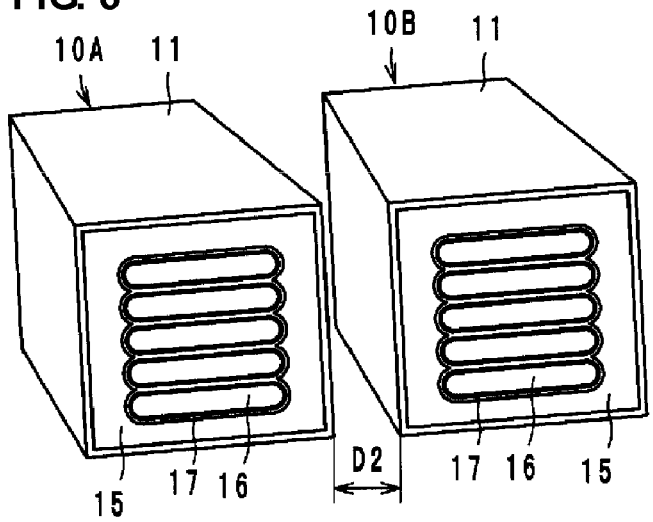
FIG. 6 is a perspective view illustrating an ion generator according to a second preferred embodiment of the present invention.

According to a second preferred embodiment of the present invention, a positive-ion generator 10A and a negative-ion generator 10B are arranged side by side as shown in FIG. 6, and an ion-generating element that generates positive ions and an ion-generating element that generates negative ions are accommodated in respective cases 11. The distance D2 between the cases 11 was about 10 mm, and the distance between two discharging needle electrodes 25 was about 30 mm, for example. Moreover, in the second preferred embodiment, covers 15 were made of alumina substrates, and resistive elements 17 were provided at peripheral portions of openings 16 and were grounded as in the first preferred embodiment. The openings 16 had a long-hole shape (cover A).

Figure 7:
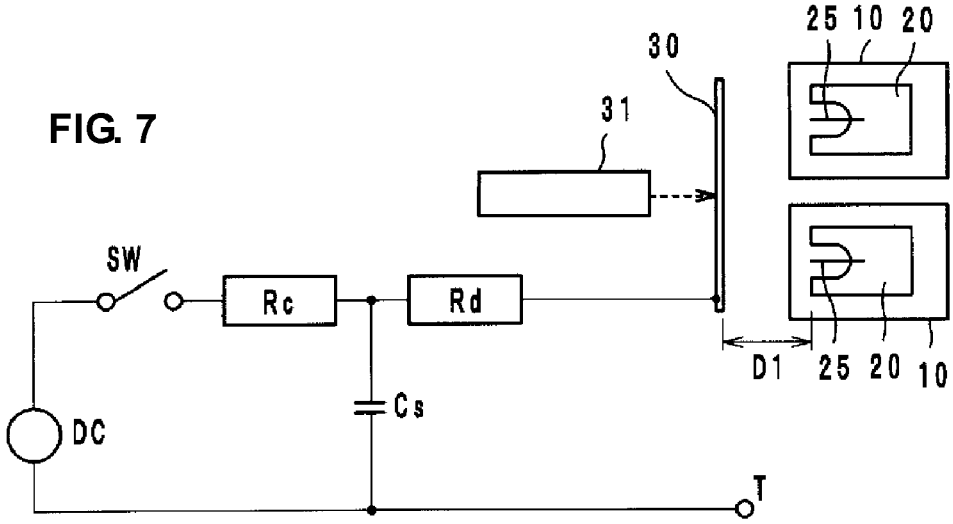
FIG. 7 is a block diagram illustrating an apparatus for measuring antistatic effects.

The inventor performed experiments on the antistatic effect achieved by the second preferred embodiment with the covers A and B by using a measuring apparatus shown in FIG. 7. Voltages of +5 kV and −5 kV were applied to the respective discharging needle electrodes 25. A charged plate 30 disposed at a position remote from the ion-generating elements 20 by a distance D1 (about 30 mm) was charged to +12 kV, and the static-elimination state of the charged plate was measured using an electrostatic potentiometer 31 in terms of time (sec). The charged plate 30 was connected to a high-voltage direct-current power source DC of 12 kV via a discharge resistor Rd of about 330Ω, a charge resistor Rc of about 1 MΩ, and a switch SW. Moreover, the midpoint of the resistors Rd and Rc was connected to a discharge return terminal T via an energy-storage capacitor Cs.

Figure 8:
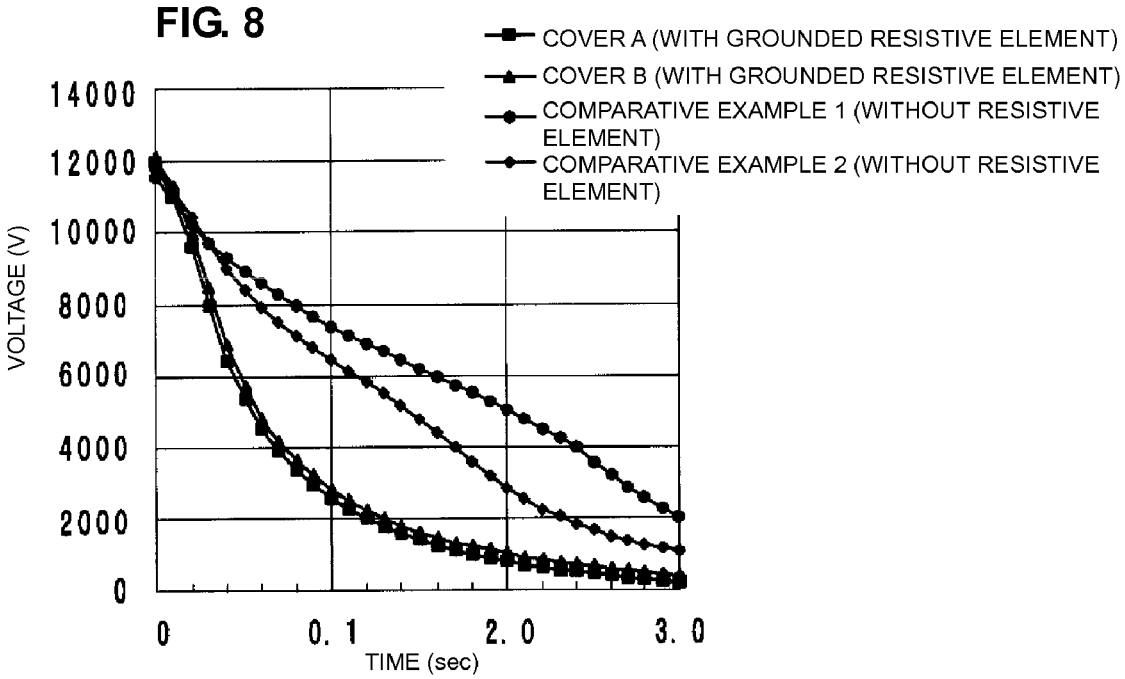
FIG. 8 illustrates the antistatic effect achieved by the second preferred embodiment of the present invention.

FIG. 8 shows the results of the above-described experiments. The ordinate represents the electrostatic potential of the charged plate 30, and the abscissa represents the time (sec) required to eliminate static electricity. In addition to the experiments using the covers A and B in the second preferred embodiment, similar experiments were also performed using covers A and B without the resistive elements 17 in Comparative Examples 1 and 2. The antistatic effects achieved by Comparative Example 1 (cover A without resistive elements) and Comparative Example 2 (cover B without resistive elements) are shown by a curved line connecting circular dots and a curved line connecting rhombic dots, respectively. The antistatic effects achieved by the second preferred embodiment are shown by a curved line connecting rectangular dots and a curved line connecting triangular dots. The second preferred embodiment in which the resistive elements 17 were grounded could eliminate static electricity to a required extent in a short time compared with Comparative Examples 1 and 2 in which the resistive elements 17 were not grounded.

The preferable antistatic effect could be achieved by the second preferred embodiment since the grounded resistive elements 17 were disposed at the peripheral portions of the openings 16 in the cover 15. These resistive elements 17 prevented the peripheral portions from being electrostatically charged, and prevented ions from remaining at the peripheral portions by moderately absorbing ions, resulting in efficient ion generation.

Experiments on the antistatic effects achieved by the second preferred embodiment, Comparative Example 3 including a cover composed of Teflon (registered trademark) and having openings formed in a stripe pattern, Comparative Example 4 including a cover composed of polypropylene and having openings formed in a stripe pattern, and Comparative Example 5 including a cover composed of a metal (nickel) and having openings formed in a stripe pattern were performed and compared. In the experiments, the static-elimination state of the charged plate 30, which was charged to +12 kV, and the static-elimination time (sec) were measured using the measuring apparatus shown in FIG. 7. Voltages of +5 kV and −5 kV were applied to the discharging needle electrodes of the respective ion-generating elements.

Figure 9:
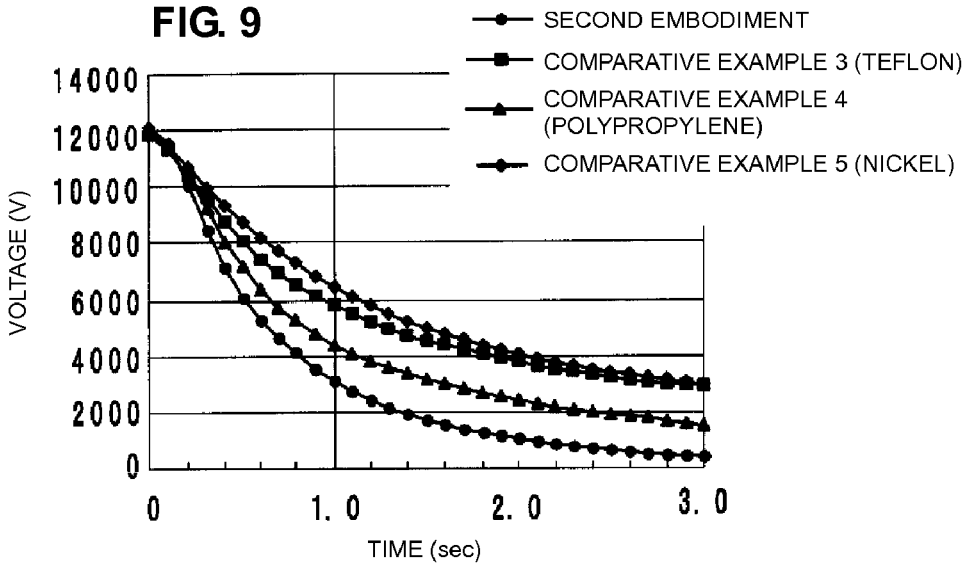
FIG. 9 illustrates the antistatic effect achieved by the second preferred embodiment of the present invention.

FIG. 9 shows the results of the above-described experiments. The ordinate represents the electrostatic potential of the charged plate 30, and the abscissa represents the time (sec) required to eliminate static electricity. The antistatic effect achieved by the second preferred embodiment is shown by a curved line connecting circular dots. The antistatic effects achieved by Comparative Examples 3, 4, and 5 are shown by curved lines connecting rectangular, triangular, and rhombic dots, respectively.

As is clear from FIG. 9, a preferable antistatic effect could be achieved by the second preferred embodiment. When the cover was composed of Teflon (registered trademark) or polypropylene, which are insulators, as in Comparative Examples 3 and 4, the peripheral portions of the openings 16 were easily electrostatically charged, and ions remained at the peripheral portions. As a result, fewer ions were generated at the discharging needle electrode 25. Moreover, when the cover was composed of a metal as in Comparative Example 5, ion absorption became too high, and the quantity of ions to be discharged was reduced.

Figure 10:
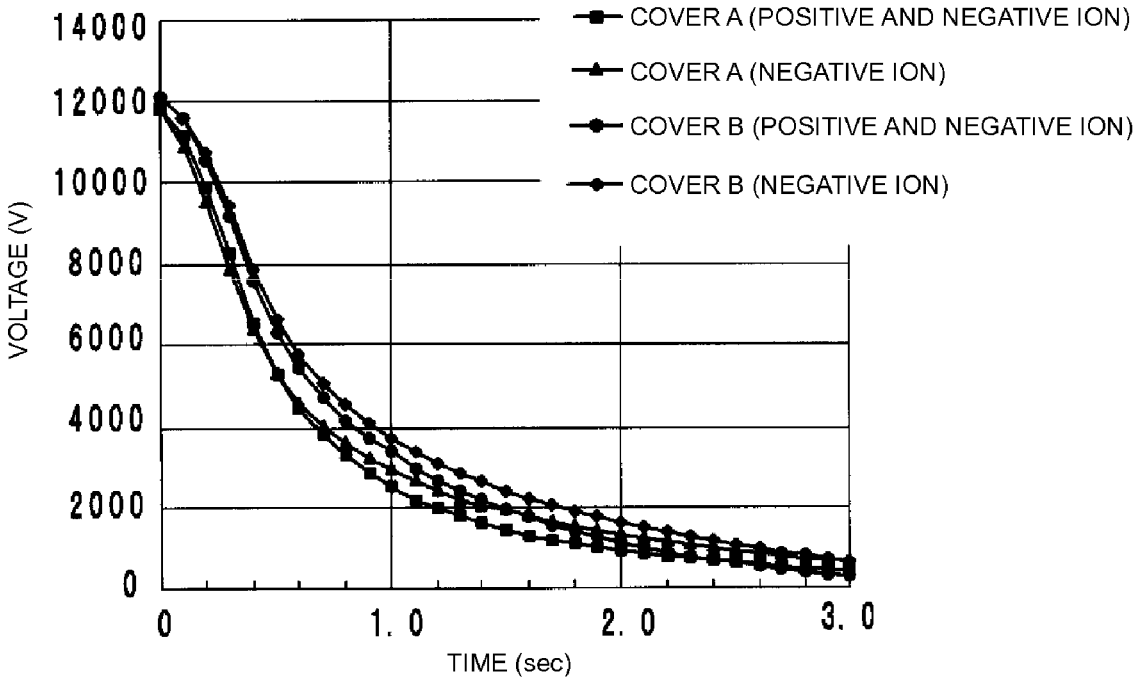
FIG. 10 illustrates the antistatic effect achieved by the second preferred embodiment of the present invention.

Moreover, the second preferred embodiment includes the ion-generating element that generates positive ions and the ion-generating element that generates negative ions unlike the first preferred embodiment. FIG. 10 shows the experimental results of the static-elimination states of the charged plate 30, which was positively charged, using the ion generators 10A and 10B each having the cover A (curved line connecting rectangular dots), using only the negative-ion generator 10B having the cover A (curved line connecting triangular dots), using the ion generators 10A and 10B each having the cover B (curved line connecting circular dots), and using only the negative-ion generator 10B having the cover B (curved line connecting rhombic dots).

As is clear from FIG. 10, the static-elimination speed was higher when both positive and negative ions were discharged by arranging the ion generators 10A and 10B side by side than when only negative ions were discharged using only the negative-ion generator 10B. This was because the ion generators 10A and 10B arranged side by side increased the electric field strengths of the ion-generating elements, thereby increasing the quantity of generated negative ions.

Third Preferred Embodiment

Figure 11:
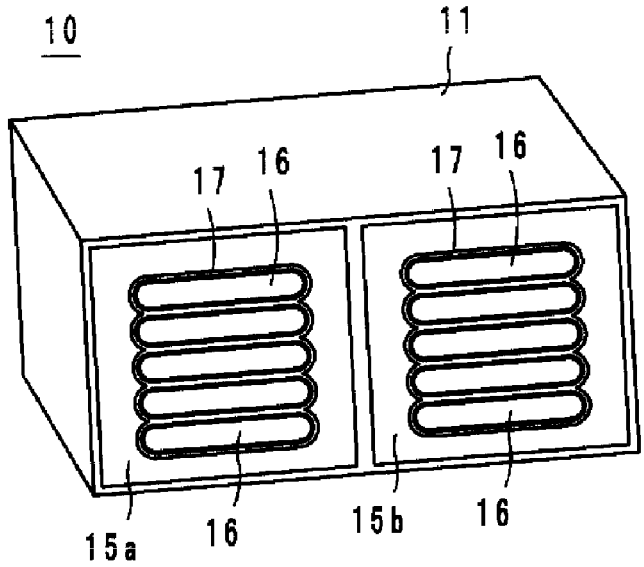
FIG. 11 is a perspective view illustrating an ion generator according to a third preferred embodiment of the present invention.
Figure 12:
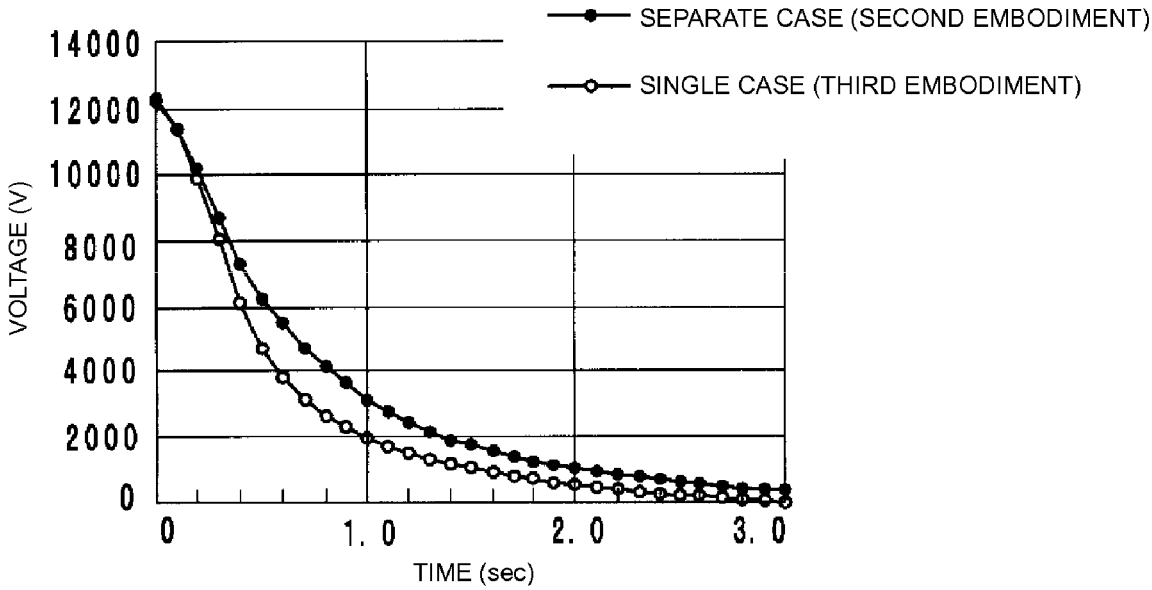
FIG. 12 illustrates the antistatic effect achieved by the third preferred embodiment of the present invention.

See FIGS. 11 and 12

As shown in FIG. 11, an ion generator 10 according to a third preferred embodiment of the present invention includes a positive-ion generating element and a negative-ion generating element in a single case 11. The case 11 includes a cover 15*a* facing the positive-ion generating element and a cover 15*b* facing the negative-ion generating element. Although the covers 15*a* and 15*b* have openings 16 as shown in FIG. 4, the covers 15*a* and 15*b* can have openings 16 as shown in FIG. 5.

When the positive-ion generating element and the negative-ion generating element are accommodated in the single case 11 as in the third preferred embodiment, the distance between discharging needle electrodes is reduced (the distance between the discharging needle electrodes was about 20 mm in the third preferred embodiment) compared with the case where the ion-generating elements are accommodated in the separate cases 11 as in the second preferred embodiment. As a result, the electric field strength at each of the ion-generating elements is increased, and the quantities of ions generated at the ion-generating elements are further increased.

FIG. 12 shows the static-elimination speed in the second preferred embodiment using the separate cases 11 and the static-elimination speed in the third preferred embodiment using the integrated case 11. The experiments were also performed using the measuring apparatus shown in FIG. 7 under conditions similar to those described above. As is clear from FIG. 12, the static-elimination speed was higher when the positive-ion generating element and the negative-ion generating element were accommodated in the single case 11.

Fourth Preferred Embodiment

Figure 13:
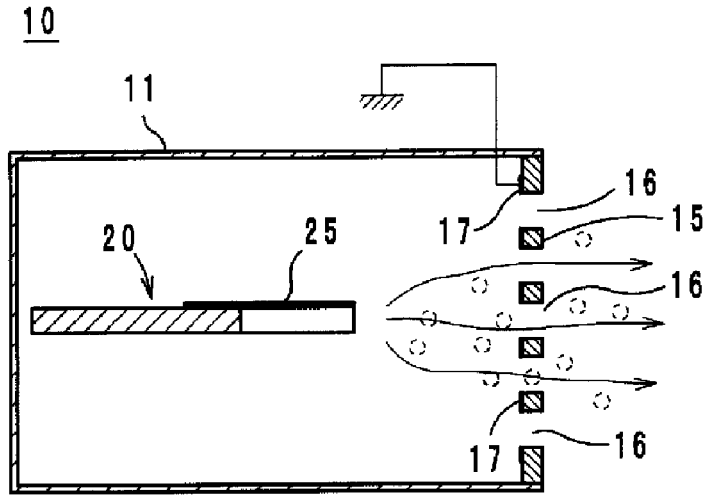
FIG. 13 is a cross-sectional view illustrating an ion generator according to a fourth preferred embodiment of the present invention.
Figure 14:
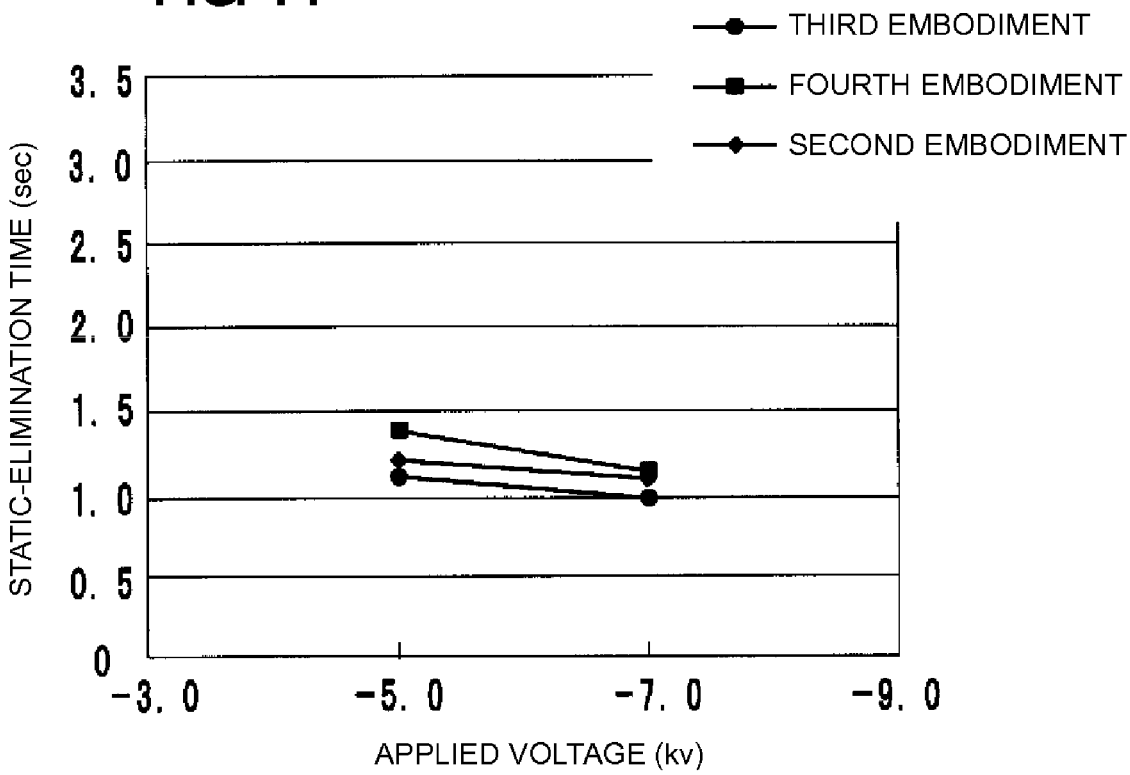
FIG. 14 illustrates the antistatic effect achieved by the fourth preferred embodiment of the present invention.

See FIGS. 13 and 14

As shown in FIG. 13, an ion generator 10 according to a fourth preferred embodiment of the present invention includes grounded resistive elements 17 disposed at peripheral portions of openings 16 on the inner surfaces of covers 15*a* and 15*b*. Two ion-generating elements that generate positive ions and negative ions are accommodated in a single case 11 as in the third preferred embodiment shown in FIG. 11.

FIG. 14 shows the time (ordinate) required to eliminate static electricity from a charged plate 30, which was charged to +12 kV, shown in FIG. 7, to +2 kV. The abscissa represents the voltage applied to the ion-generating elements. Rectangular dots show the time required to eliminate static electricity in the fourth preferred embodiment (the positive-ion generating element and the negative-ion generating element were accommodated in the single case 11, and the grounded resistive elements 17 were disposed on the inner surfaces of the covers 15*a* and 15*b*). Circular dots show the time required to eliminate static electricity in the third preferred embodiment (the positive-ion generating element and the negative-ion generating element were accommodated in the single case 11, and the grounded resistive elements 17 were disposed on the outer surfaces of the covers 15*a* and 15*b*). Furthermore, rhombic dots show the time required to eliminate static electricity in the second preferred embodiment (the positive-ion generating element and the negative-ion generating element were accommodated in the two respective cases 11, and the grounded resistive elements 17 were disposed on the outer surfaces of the covers 15*a* and 15*b*).

Although the antistatic effect achieved by the fourth preferred embodiment was more preferable than that of the known technology, the antistatic effect was not necessarily higher than those achieved by the second preferred embodiment and the third preferred embodiment. Since ion discharge from the openings 16 was promoted by preventing the outer surfaces of the covers 15*a* and 15*b* from being electrostatically charged, the antistatic effects achieved by the second preferred embodiment and the third preferred embodiment in which the resistive elements 17 were disposed on the outer surfaces of the covers 15*a* and 15*b* were higher than that achieved by the fourth preferred embodiment in which the resistive elements 17 were disposed on the inner surfaces of the covers 15*a* and 15*b*. That is, although the inner surfaces of the covers 15*a* and 15*b* were prevented from being electrostatically charged, ion discharge from the openings 16 was suppressed and prevented since the outer surfaces of the covers were electrostatically charged in the fourth preferred embodiment. Accordingly, ions can be efficiently discharged to the outside by preventing the outer surfaces of the covers 15*a* and 15*b* from being electrostatically charged. The ion discharge to the outside prevents remaining ions, thereby promoting ion generation.

Fifth Preferred Embodiment

Figure 15:
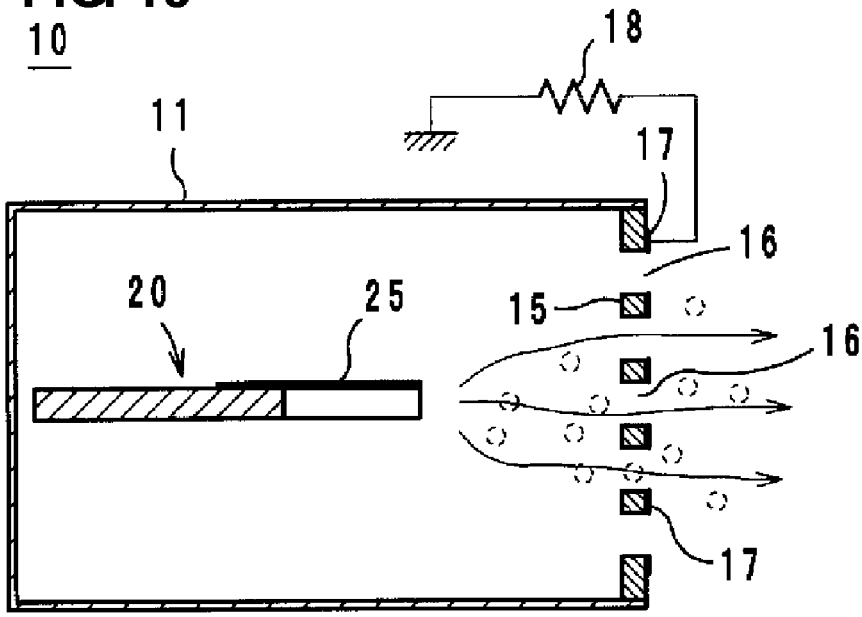
FIG. 15 is a cross-sectional view illustrating an ion generator according to a fifth preferred embodiment of the present invention.
Figure 16:
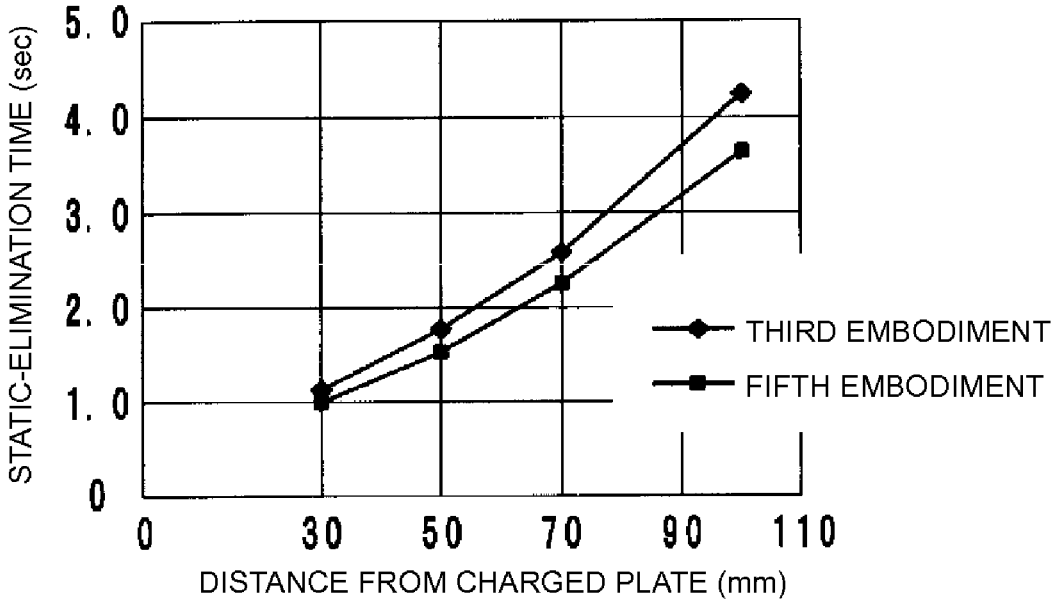
FIG. 16 illustrates the antistatic effect achieved by the fifth preferred embodiment of the present invention.
Figure 17:
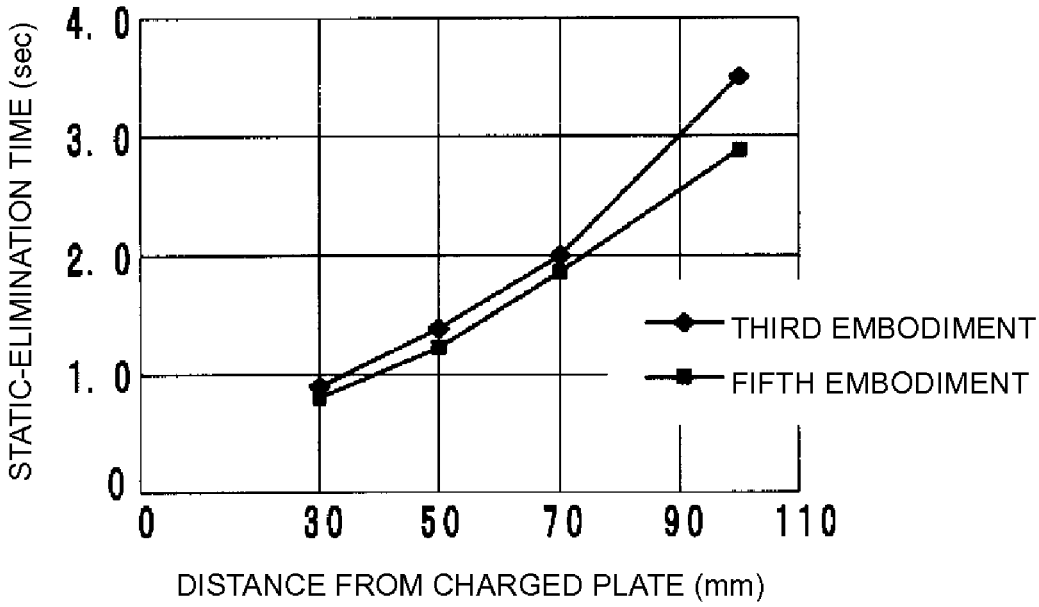
FIG. 17 illustrates the antistatic effect achieved by the fifth preferred embodiment of the present invention.

See FIGS. 15 to 17

As shown in FIG. 15, an ion generator 10 according to a fifth preferred embodiment of the present invention has a structure similar to that of the third preferred embodiment shown in FIG. 11 other than resistive elements 17 grounded via a limiting resistor 18. The resistance of the limiting resistor 18 is, for example, about 2 GΩ, and slightly suppresses the ion absorption by limiting the current passing through the resistive elements 17. With this, the quantity of ions discharged from openings 16 can be increased.

FIGS. 16 and 17 show the antistatic effects achieved by the fifth preferred embodiment and the third preferred embodiment for comparison. The antistatic effects were shown by the time (ordinate) required to eliminate static electricity from a charged plate 30, which was charged to +12 kV, shown in FIG. 7, to +2 kV. The abscissa represents the distance D1 between ion-generating elements and the charged plate 30 (see FIG. 7). FIG. 16 shows the antistatic effects when voltages of +5 kV and −5 kV were applied to the respective ion-generating elements, and FIG. 17 shows the antistatic effects when voltages of +7 kV and −7 kV were applied to the respective ion-generating elements. As is clear from FIGS. 16 and 17, the static-elimination speed was increased by grounding the resistive elements 17 via the limiting resistor 18.

Summary of Preferred Embodiments

In the above-described ion generators, it is preferable that the sheet resistivities of the resistive elements range from about 1 MΩ/mm$^2$ to about 15 MΩ/mm$^2$, for example, and that the resistive elements be disposed on the outer surface of the cover. With this, the resistive elements moderately absorb ions outside the cover, and promote ion generation. It is preferable that the cover have a plurality of openings, thereby achieving efficient ion discharge. Moreover, the cover can be formed of an alumina substrate. The alumina substrate is not easily charged with ions, and the resistive elements can be easily formed on the substrate.

On the other hand, it is preferable that the resistive elements be cermet resistors or carbon resistors. These resistors advantageously have stable resistances and do not deteriorate markedly.

Moreover, the ion generator according to various preferred embodiments of the present invention can include a positive-ion generating element that generates positive ions and a negative-ion generating element that generates negative ions. In this case, it is preferable that the positive-ion generating element and the negative-ion generating element be accommodated in a single case. When the positive-ion generating element and the negative-ion generating element are accommodated in the single case, the electric field strengths are increased, and the amounts of ions generated by the respective ion-generating elements are increased.

Moreover, a limiting resistor can be connected to the resistive elements. The limiting resistor suppresses ion absorption by the resistive elements such that excessive ion absorption is prevented, thereby increasing the amount of ions to be discharged.

Other Preferred Embodiments

The ion generator according to the present invention is not limited to the above-described preferred embodiments, and various modifications are possible within the scope of the invention.

For example, the openings formed in the cover can have various shapes other than those shown in FIGS. 4 and 5. Moreover, the ion-generating elements can have any structure or shape in the details, and AC voltages can be superposed on the DC voltages so as to generate ions.

As described above, the present invention relates to an ion generator, and has particular advantages of efficiently generating and discharging ions.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An ion generator comprising:

a case;

an ion-generating element provided in the case and including a discharging needle electrode and a ground electrode facing the discharging needle electrode;

a cover included in the case and having an opening that faces the discharging needle electrode; and a grounded resistive element provided at a peripheral portion of the opening; wherein the resistive element is disposed on an outer surface of the cover.

2. The ion generator according to claim 1, wherein a sheet resistivity of the resistive element ranges from about 1 MΩ/mm$^2$ to about 15 MΩ/mm$^2$.

3. The ion generator according to claim 1, wherein the cover further comprises one or more openings.

4. The ion generator according to claim 1, wherein the cover includes an alumina substrate.

5. The ion generator according to claim 1, wherein the resistive element is a cermet resistor or a carbon resistor.

6. The ion generator according to claim 1, wherein the ion-generating element comprises a positive-ion generating element arranged to generate positive ions and a negative-ion generating element that generates negative ions.

7. The ion generator according to claim 6, wherein the positive-ion generating element and the negative-ion generating element are accommodated in the case.

8. The ion generator according to claim 1, wherein a limiting resistor is connected to the resistive element.

* * * * *